420-490 SR
5/16/86 XR 4,612,166

United States Patent [19]
Brock et al.

[11] Patent Number: 4,612,166
[45] Date of Patent: Sep. 16, 1986

[54] COPPER-SILICON-TIN ALLOYS HAVING IMPROVED CLEANABILITY

[75] Inventors: Andrew J. Brock, Cheshire; Edward F. Smith, Madison; Eugene Shapiro, Hamden, all of Conn.

[73] Assignee: Olin Corporation, New Haven, Conn.

[21] Appl. No.: 787,341

[22] Filed: Oct. 15, 1985

[51] Int. Cl.[4] ..... C22C 9/02; C22C 9/10
[52] U.S. Cl. ..... 420/470; 420/490; 420/494; 148/12.7 C
[58] Field of Search ..... 420/470, 490, 494

[56] References Cited

U.S. PATENT DOCUMENTS

| | | | |
|---|---|---|---|
| 2,035,414 | 3/1936 | Wilkins | 420/473 |
| 2,157,149 | 5/1939 | Smith et al. | 420/490 |
| 2,157,934 | 5/1939 | Hensel et al. | 148/414 |
| 2,212,017 | 8/1940 | Fletcher | 420/490 |
| 3,923,555 | 12/1975 | Shapiro et al. | 148/11.5 C |
| 4,148,633 | 4/1979 | Parikh | 148/11.5 C |
| 4,264,360 | 4/1981 | Parikh et al. | 148/11.5 C |
| 4,434,016 | 2/1984 | Saleh et al. | 148/12.7 C |

FOREIGN PATENT DOCUMENTS 1431729 4/1976 United Kingdom .

*Primary Examiner*—Veronica O'Keefe
*Attorney, Agent, or Firm*—Barry L. Kelmachter; Howard M. Cohn; Paul Weinstein

[57] ABSTRACT

The present invention relates to copper-silicon-tin alloys having improved cleanability. These alloys consist essentially of from about 1.0% to about 5.0% tin, from about 1.0% to about 4.5% silicon, an element selected from the group consisting of from about 0.05% to about 0.5% magnesium and from about 0.01% to about 0.5% lithium, and the balance essentially copper. The alloys may also contain from about 0.01% to about 0.45% chromium.

8 Claims, 3 Drawing Figures

COPPER-SILICON-TIN ALLOYS HAVING IMPROVED CLEANABILITY

This invention relates to a copper base alloy containing additions of silicon, tin and an element selected from the group consisting of magnesium and lithium to improve the cleanability of the alloy. In a preferred embodiment, the alloy also contains chromium.

Copper alloys containing silicon, tin, and one or more other alloying elements are known in the art. U.S. Pat. Nos. 2,035,414 to Wilkins and 3,923,555 to Shapiro et al. illustrate some of these alloys. One of the problems associated with these alloys is the inability to easily clean them in times compatible with commercially useful line speeds. During normal heat treatments of copper-silicon-tin alloys, such as annealing in reducing atmospheres, refractory oxides consisting of $SiO_2$ and $SnO_2$ are formed. Silica predominates in the oxides and causes one of the most severe cleaning problems in the industry. This is because it forms a relatively thick external scale with an underlying zone of internal oxidation having deep intergranular penetration, particularly at the grain boundaries. Cleaning of the material, therefore, requires extensive dissolution of the base metal to allow effective removal of the refractory oxide particles. Such cleaning is generally a very slow process, often requiring more than a single pass through a cleaning line. An effective solution to this cleaning problem has been sought for some time.

Other problems caused by the presence of these oxides are impaired alloy solderability and excessive tool wear. The problem of excessive tool wear is caused by the extremely abrasive quality of these oxides.

In U.S. Pat. No. 4,148,633 to Parikh, there is disclosed a silicon-tin containing copper base alloy to which mischmetal is added to improve the resistance to edge cracking during hot working of the alloy. Various other elements such as chromium, manganese, iron and nickel may also be added to the alloy to increase its strength properties without affecting the hot workability improvements resulting from the mischmetal addition. In U.S. Pat. No. 4,264,360 to Parikh et al., a chromium modified silicon-tin containing copper base alloy having improved resistance to edge cracking during hot rolling and reduced tool wear properties is disclosed. There is no disclosure in either of these patents of improving alloy cleanability by making a selective alloying addition.

Accordingly, it is an object of the present invention to provide copper-silicon-tin alloys having improved cleanability.

It is a further object of the present invention to provide an alloy as above having improved solderability and tool wear properties.

It is yet a further object of the present invention to provide an alloy as above which can be produced at a reduced cost.

These and other objects and advantages will become more apparent from the following description.

In accordance with the present invention, the foregoing objects are achieved by making a selective alloying addition to a copper-silicon-tin alloy. The alloying addition is made to significantly decrease the extent of the oxides formed during heat treatment of the alloys. This selective alloying addition comprises the addition of minor amounts of an element selected from the group consisting of magnesium and lithium. The benefits obtained by the use of these additions include the use of significantly higher speeds in the commercial continuous cleaning of the strip annealed alloy and a significant reduction in cost. The cost reduction is in part a result of having to remove less metal during cleaning of the alloy.

It has been suprisingly found that the addition of magnesium or lithium to these alloys causes a modification in the oxide films produced during conventional heat treatments including annealing. This modification, which is the appearance of oxides such as MgO and $Li_2SiO_3$ in the oxide film, is reflected in the ability to more easily clean the alloys of the present invention. While the mechanism by which these additions decrease the extent of the internal oxidation zone is not completely understood, it has been postulated that the oxides produced as a result of these additions provide much higher resistance to the ingress of oxygen. These oxides are incorporated into the overall oxide not only by direct oxidation but also by the reduction of the refractory oxides $SiO_2$ and $SnO_2$. In the case of MgO, this leads to the formation of acid soluble MgO at the metal-oxide interface. The ready dissolution of this oxide in mineral acids gives the oxidizing solutions access to the underlying metal, hence, accelerating the cleaning process. The predominant reason for the acceleration in the cleaning process is believed to be that the depth of internal oxidation is less so that less metal dissolution is necessary to remove the metal which contains this oxide.

In the aforementioned Shapiro et al. patent, magnesium in the range of about 0.01% to about 2.0% by weight is disclosed as one of many possible addition elements which could be added to a copper base alloy containing silicon and tin. However, there is no disclosure of a single exemplary alloy including magnesium. Further, there is no recognition of the improvements in cleaning to be obtained by making a minor magnesium or lithium addition to the copper-silicon-tin alloy.

Copper base alloys in accordance with the present invention exhibit improved cleanability and may contain from about 1.0% to about 5.0% tin, from about 1.0% to about 4.5% silicon, an element selected from the group consisting of from about 0.05% to about 0.5% magnesium and from about 0.01% to about 0.5% lithium, and the balance essentially copper. These copper base alloys may also contain from about 0.01% to about 0.45% chromium. Preferred chromium additions are in the range of from about 0.01% to about 0.12% chromium.

Alloys in accordance with a preferred embodiment of the present invention consist essentially of from about 2.0% to about 4.0% silicon, from about 1.0% to about 3.0% tin, an element selected from the group consisting of from about 0.05% to about 0.3% magnesium and from about 0.04% to about 0.1% lithium, and the balance essentially copper. The sum of the tin and silicon content in these preferred alloys is preferably less than about 6.0%.

As used herein, the foregoing percentages are weight percentages.

Figure 1:
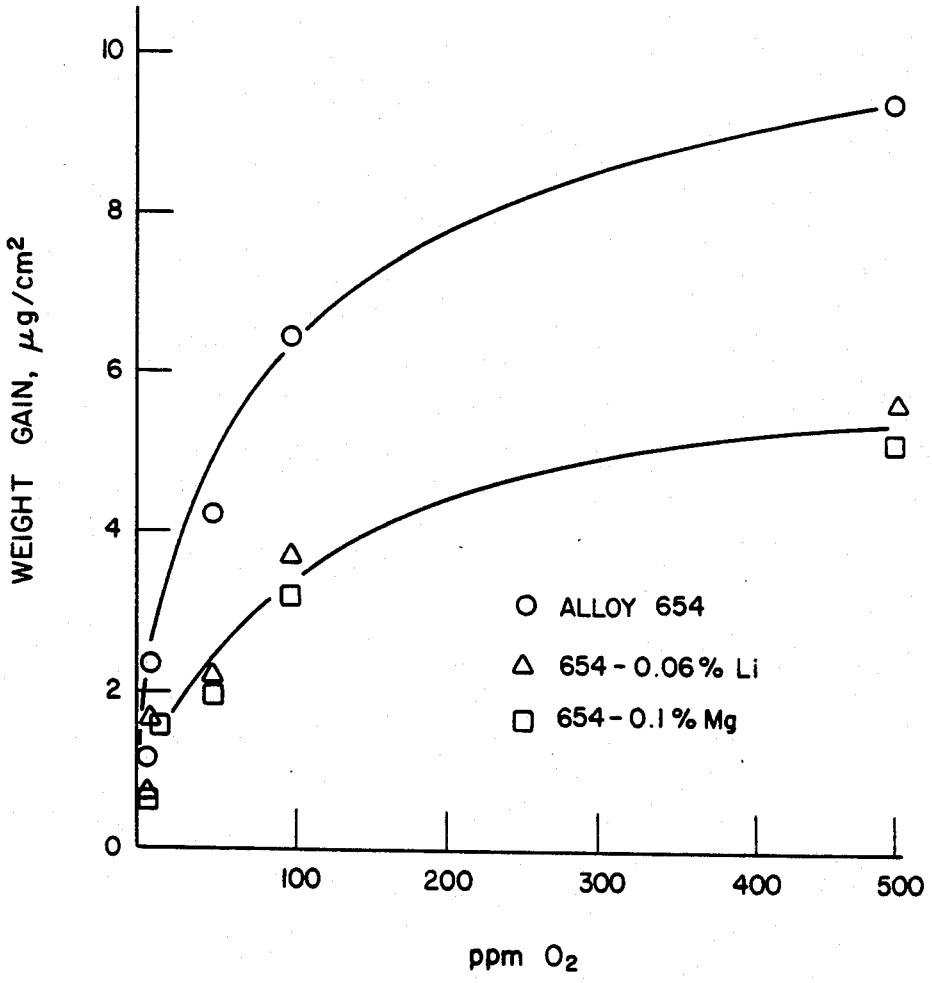
FIG. 1 is a graph illustrating the weight gain of bell annealed copper-silicon-tin alloys with and without magnesium or lithium.

The copper base alloys of the present invention are particularly adapted for spring applications. The alloys are relatively low in cost as compared to alloys with comparable properties such as beryllium-copper. The alloys further exhibit outstanding stress corrosion resistance, good formability and excellent stress relaxation at room and elevated temperatures.

It has been suprisingly found in accordance with this invention that when magnesium or lithium within certain critical limits is added to copper-silicon-tin alloys that the alloys exhibit improved cleanability. As previously discussed while the mechanism for improving the cleanability of these alloys is not completely understood, it is believed that the addition of either of these elements promotes the formation of oxides which provide an increased resistance to the ingress of oxygen. The oxides are incorporated into the overall oxide not only by direct oxidation but also by the reduction of the refractory oxides $SiO_2$ and $SnO_2$. The predominant reason for the acceleration in the cleaning process appears to be that the depth of internal oxidation is less so that less metal dissolution is necessary to remove the oxide containing metal. The only constraint on using these alloying additions appears to be the maximum amount of the alloying addition which can be present without impairing the hot rollability of the alloy.

Copper-silicon-tin alloys in accordance with the present invention consist essentially of from about 1.0% to about 5.0% tin, from about 1.0% to about 4.5% silicon, an element selected from the group consisting of from about 0.05% to about 0.5% magnesium and from about 0.01% to about 0.5% lithium, and the balance essentially copper. The alloys may also contain from about 0.01% to about 0.45% chromium to provide resistance to edge cracking during hot rolling and improved tool wear properties. The amount of either magnesium or lithium in these alloys is limited within the foregoing ranges beacuse additions in excess of 0.5% have been found to adversely affect the hot rollability of the alloys.

In a preferred embodiment of the present invention, either magnesium in the range of about 0.05% to about 0.3% or lithium in the range of about 0.04% to about 0.1% is added to improve the cleanability of the copper-silicon-tin alloys. Magnesium is a preferred addition when the alloy is to be bell annealed and lithium is a preferred addition when the alloy is to be strip annealed—particularly in atmospheres having a high oxygen content i.e. 450 ppm $O_2$ or greater.

While the chromium content of the alloys may be in the aforementioned range, it is preferred that it be in a range of from about 0.01% to about 0.12%. In addition, preferred ranges for the silicon and tin content of the alloys of the present invention are from about 2.0% to about 4.0% silicon and about 1.0% to about 3.0% tin, respectively, with the silicon plus tin content being less than about 6.0%. As previously mentioned, the foregoing percentages are all weight percentages.

The processing of the alloy systems of the present invention generally follows along the same lines as the processing outlined in U.S. Pat. Nos. 3,923,555, 4,148,633 and 4,264,360, which are all hereby incorporated by reference herein. The alloys of the present invention may first be cast by any suitable method and preferably by direct chill or continuous casting methods in order to provide a better cast structure to the alloy. After casting, the alloy is preferably heated to between about 600° C. and the solidus temperature of the particular alloy within the system for at least 15 minutes. The alloy is then hot worked from a starting temperature in excess of 650° C. up to within about 50° C. of the particular solidus temperature. The temperature at the completion of the hot working step should be greater than about 400° C. It should be noted that the particular solidus temperature of the alloy being worked will depend upon the particular amounts of silicon, tin, magnesium or lithium, and/or chromium within the alloy as well as any other minor additions present in the alloy. The particular percentage reduction during the hot working step is not particularly critical and will depend upon the final gage requirements necessary for further processing.

After being hot worked, the alloy may be subjected to an annealing temperature between about 330° C. and about 600° C. for approximately 0.5 to 8 hours. The annealing temperature should preferably be between about 350° C. and about 550° C. for about 0.5 to about 2 hours. Alternatively, the alloy may be strip annealed at a temperature in the range of about 800° C., to about 850° C. The annealing step may be performed either immediately following the hot working step or during processing of the alloy into a desired product. Depending upon the desired properties, the alloy can be cold worked to any desired reduction with or without intermediate annealing to form either temper worked strip material or heat treated strip material. A plurality of cold working and annealing cycles may be employed if so desired.

The processing procedure may also contain a heat treatment step either in the interannealing procedure or as a final annealing procedure to obtain improvement in the strength to ductility relationship in the alloy. This heat treatment step may be performed at a temperature between about 250° C. and about 850° C. for at least 10 seconds, preferably for a time period in the range of about 0.5 hours to about 24 hours. If a heat treatment is desired in order to provide greater stress relaxation properties, this particular heat treatment step may be performed at a temperature between about 150° C. and about 400° C. for from about 15 minutes to about 8 hours. This latter heat treatment comprises a stabilization anneal. A stabilization anneal is a low temperature thermal treatment performed preferably by the customer after the alloy is formed into a desired product or part having a desired shape. This treatment does not significantly change tensile properties but serves to improve the stiffness of the alloy and its stress relaxation resistance.

After being processed into a desired product such as strip material, the alloys of the present invention may be cleaned using any suitable cleaning treatment known in the art. For example, the material may be first immersed in a caustic solution such as an aqueous 1N. NaOH solution and afterwards immersed in an aqueous 12 wt. % $H_2SO_4$/3 wt. % $H_2O_2$ solution. It has been found that the alloys of the present invention may be cleaned with this type of treatment in shorter times than previously required. Prior to the present invention, copper-silicon-tin alloys were typically cleaned by immersion in a boiling caustic solution followed by dissolution in an agressive oxidizing solution such as 1.4N to 2.0N ferric sulfate solution.

To illustrate the present invention, the following examples were performed.

EXAMPLE I

To demonstrate the effect of magnesium and lithium alloying additions on copper-silicon-tin alloys, samples of copper alloy 654 with and without lithium or magnesium additions were prepared. The alloy samples had the nominal compositions given in Table I.

TABLE I

| Composition of Experimental Copper Alloys (Weight %) | | | | | | |
|---|---|---|---|---|---|---|
| Nominal | Sn | Si | Mg | Li | Cr | Cu |
| 654 | 1.68 | 2.93 | | | .026 | bal. |
| 654/0.1 Mg | 1.61 | 2.91 | 0.093 | | .057 | bal. |
| 654/0.06 Li | 1.79 | 2.87 | | 0.045 | .006 | bal. |

The alloys were cast as 10 lb. Durville ingots. They were hot and cold rolled with intermediate anneals to 0.030" gage. After each anneal the samples were cleaned using boiling 1N caustic soda solution followed by immersion in 2N ferric sulfate solution at 80° C.

Prior to the annealing experiments, the samples were degreased thoroughly with toulene and rinsed with methanol. They were then cleaned by immersion for 20 sec. in 12 wt % sulfuric acid at 50° C. in order to remove any tarnish films. This was followed by rinsing in running deionized water. The metal samples were sheared into coupons of either 0.5"×1.5" or 1"×2". The smaller samples were used for strip annealing experiments and the larger ones for bell annealing studies.

Samples of each alloy were given simulated Bell annealing cycles for 4 hours at 380° C. Nitrogen gas with less than 1 ppm $O_2$ and a dewpoint of −40° C. was used. Annealing was conducted in the same gas using a dew point of 25° C. with oxygen at levels of 10, 50, 100, and 500 ppm. FIG. 1 shows plots of weight gain during bell annealing as a function of the oxygen content of the annealing atmosphere. It is clear from this figure that the alloying additions of the present invention have a significant effect on decreasing the amount of oxide produced during the annealing of copper-silicOn-tin alloys—lower weight gains indicating less oxide production.

Figure 2:
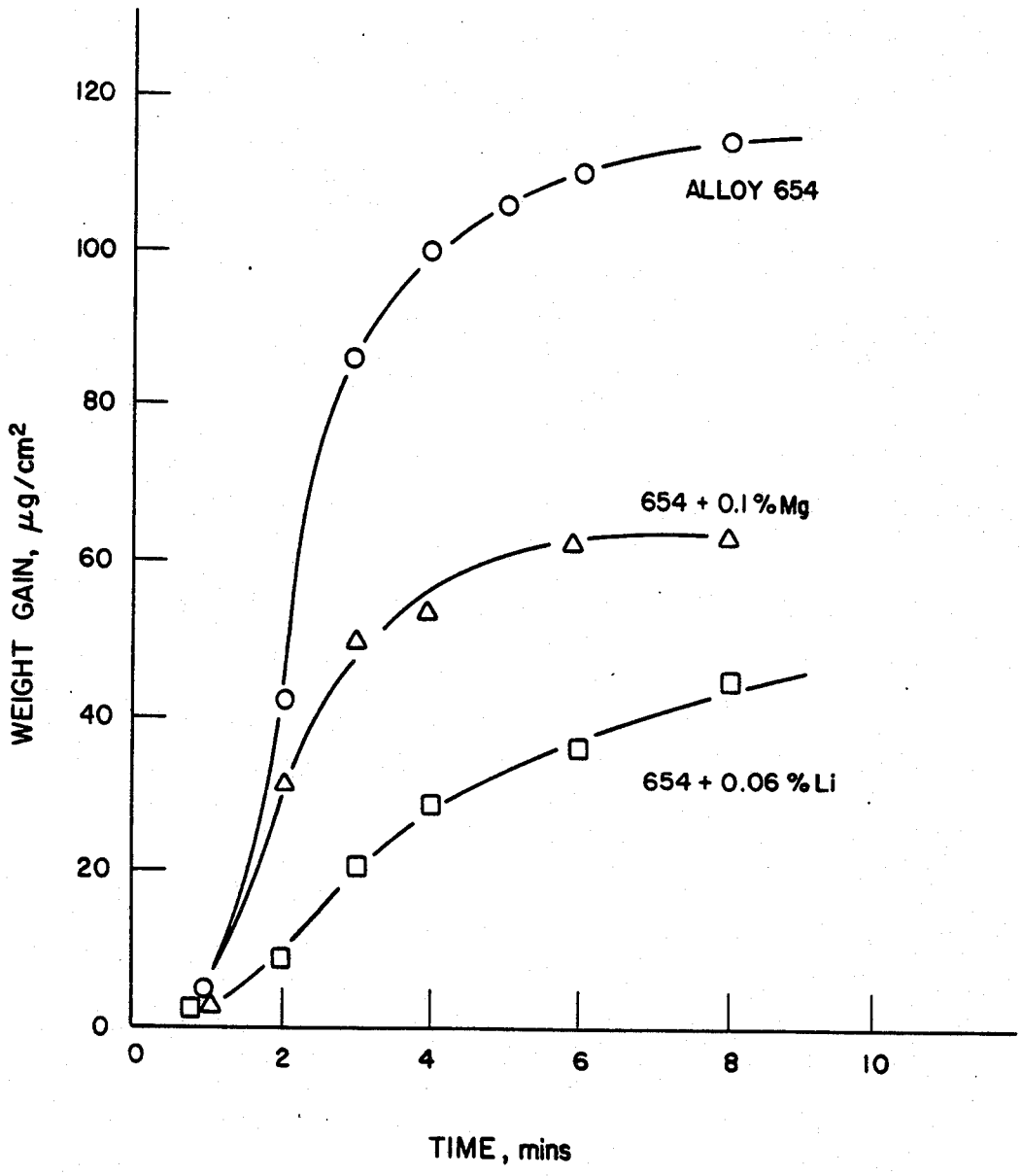
FIG. 2 is a graph illustrating the weight gain of copper-silicon-tin alloys with or without magnesium or lithium which have been strip annealed in a reducing gas containing no oxygen.
Figure 3:
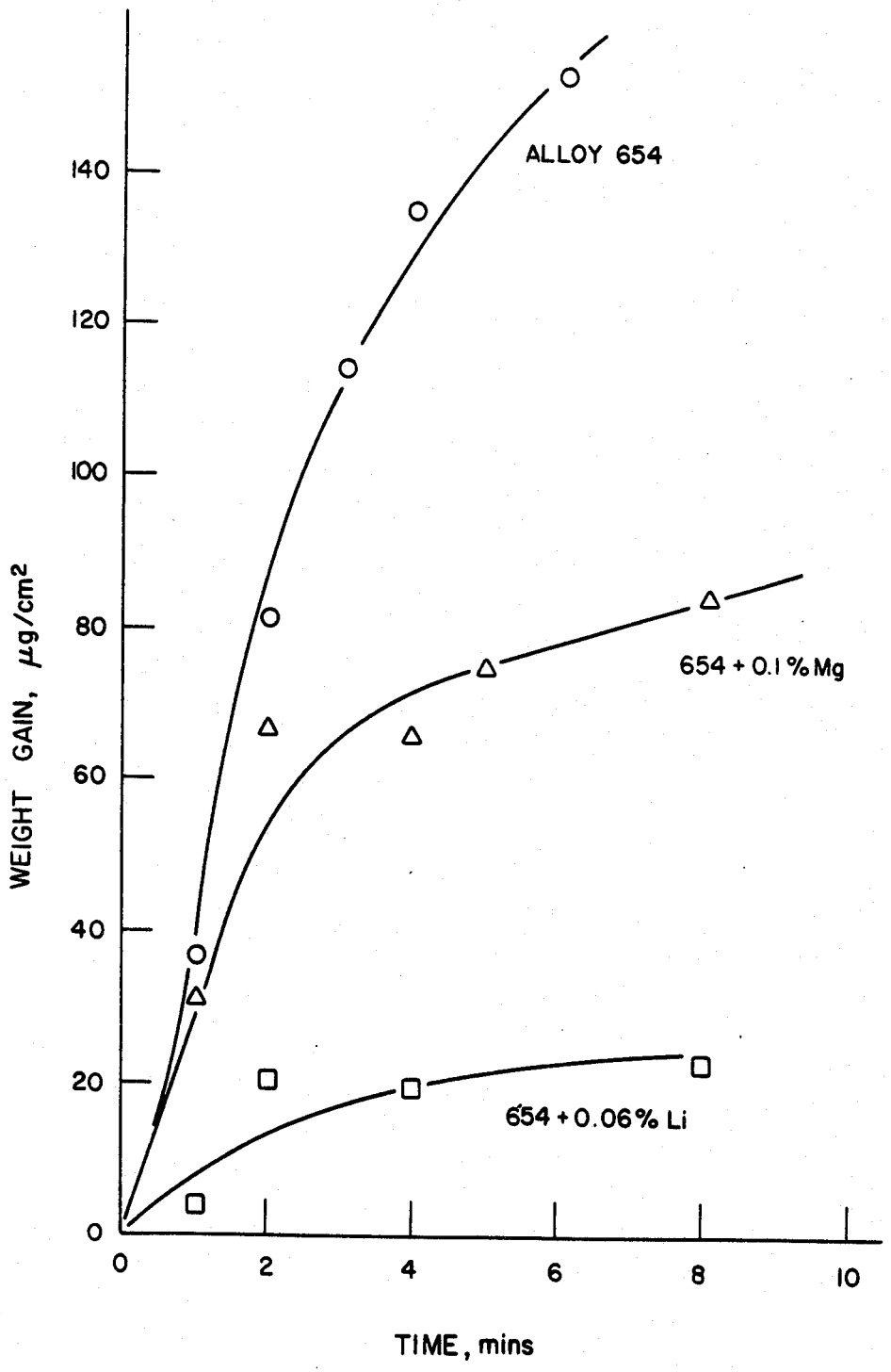
FIG. 3 is a graph illustrating the weight gain of copper-silicon-tin alloys with or without magnesium or lithium which have been strip annealed in a reducing gas containing 450 ppm $O_2$.

Other samples of each alloy were given simulated strip anneals for time periods ranging from 1 to 8 minutes in the aforementioned reducing gas mixture. The oxygen content of the gas mixture was adjusted to 0 or 450 ppm $O_2$. FIGS. 2 and 3 show the weight gain curves obtained during strip annealing as a function of annealing time. Here too, the alloys of the present invention exhibited lower weight gains indicating less oxide had been produced.

EXAMPLE II

To demonstrate the improved cleanability of the alloys of the present invention, samples of copper alloy 654 with or without lithium or magnesium additions were prepared as in Example I. The samples were strip annealed in a reducing gas containing 500 ppm $O_2$ for times of 1 minute and 2 minutes. The samples were then cleaned by immersion in boiling 1N NaOH solution for a time of either 15, 20, 30 or 40 sec. followed by immersion in an aqueous 3 wt % $H_2O_2$/12 wt % $H_2SO_4$ solution at 43° C. for the same time. For comparison purposes, a sample of copper alloy 654 without a lithium or magnesium addition was cleaned by immersion for 40 sec. in a 2N. ferric sulfate solution at 80° C.

The cleanliness of the samples was determined by solder testing in which treated samples were immersed in 60-40 Sn/Pb solder at 460° F. for 5 seconds using 611 rosin flux. The quality of the coating is assessed and is given a rating ranging from Class 1 to Class 5 based on the solder coverage. This technique makes use of the fact that refractory oxides are not wet by the solder. The classifications are:

Class 1: Smooth mirror like coating
Class 2: Rough coating but no dewetting
Class 2a: Up to 5% dewetted areas
Class 3: Up to 50% dewetted areas or 10% pinholes
Class 4: Greater than 50% dewetted or 10% pinholes
Class 5: No solder coverage Table II reports the results of this experiment. The decrease in oxidation rendered by the magnesium and lithium additions is reflected in their cleanabilities.

TABLE II

| Solderability of Simulated Strip Annealed 654 Alloy Following Cleaning | | | | |
|---|---|---|---|---|
| Alloy | Annealing Time (min) | Cleaning Method | Immersion Time (sec) | Solder Class |
| 654 | 1 | caustic/ $H_2O_2/H_2SO_4$ | 20 | 4–5 |
| | " | caustic/ $H_2O_2/H_2SO_4$ | 30 | 4–5 |
| | " | caustic/ $H_2O_2/H_2SO_4$ | 40 | 1–2a |
| 654-0.1 Mg | " | caustic/ $H_2O_2/H_2SO_4$ | 15 | 3 |
| | " | caustic/ $H_2O_2/H_2SO_4$ | 20 | 1 |
| 654-0.06 Li | " | caustic/ $H_2O_2/H_2SO_4$ | 15 | 2a–3 |
| | " | caustic/ $H_2O_2/H_2SO_4$ | 20 | 1 |
| 654 | 2 | caustic/ $H_2O_2/H_2SO_4$ | 40 | 4 |
| | " | caustic/Ferric Sulfate | 40 | 1 |
| 654-0.1 Mg | " | caustic/ $H_2O_2/H_2SO_4$ | 20 | 3 |
| | " | caustic/ $H_2O_2/H_2SO_4$ | 30 | 1 |
| 654-0.06 Li | " | caustic/ $H_2O_2/H_2SO_4$ | 15 | 3 |
| | " | caustic/ $H_2O_2/H_2SO_4$ | 20 | 1 |

It is apparent from a consideration of Table II that after being annealed for 2 minutes in an atmosphere containing 500 ppm $O_2$, copper alloy 654 required a 40 sec. treatment in a caustic-2N ferric sulfate process to obtain a class 1 solderability which is characteristic of clean metal. In comparison, the alloys containing magnesium or lithium were able to obtain a class 1 solderability after being given a caustic/hydrogen peroxide-sulfuric acid cleaning treatment for 30 seconds and 20 seconds, respectively. Copper alloy 654 when subjected to the same caustic/hydrogen peroxide-sulfuric acid cleaning treatment for 40 seconds was only able to obtain a solderability of 4.

Unless otherwise excluded by the claims appended hereto other elements can be added to the alloys of this invention if they do not materially adversely affect the basic and novel properties and characteristics of the alloys.

The U.S. patents set forth in this application are intended to be incorporated by reference herein.

It is apparent that there has been provided in accordance with the present invention copper-silicon-tin alloys having improved cleanability which fully satisfy the objects, means and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

What is claimed:

1. A copper base alloy exhibiting improved cleanability, said alloy consisting essentially of: from about 1.0% to about 5.0% tin, from about 1.0% to about 4.5% silicon, an element selected from the group consisting of from about 0.05% to about 0.5% magnesium and from about 0.01% to about 0.5% lithium, and the balance essentially copper.

2. The alloy of claim 1 wherein said silicon content is from about 2.0% to about 4.0%, said tin content is from about 1.0% to about 3.0% and the sum of said silicon and tin is less than about 6.0%.

3. The alloy of claim 1 further containing from about 0.01% to about 0.45% chromium.

4. The alloy of claim 3 wherein said chromium content is from about 0.01% to about 0.12%.

5. The alloy of claim 1 wherein said selected element comprises magnesium.

6. The alloy of claim 5 wherein said magnesium content is from about 0.05% to about 0.3%.

7. The alloy of claim 1 wherein said element comprises lithium.

8. The alloy of claim 7 wherein said lithium content is from about 0.04% to about 0.1%.

* * * * *